US006085543A

United States Patent [19]

Su

[11] Patent Number: 6,085,543

[45] Date of Patent: Jul. 11, 2000

[54] COOLING MUG

[75] Inventor: Chin-Cheng Su, Tainan, Taiwan

[73] Assignee: Wea Bor Co., Ltd., Tainan, Taiwan

[21] Appl. No.: 09/402,000

[22] Filed: Sep. 23, 1999

[30] Foreign Application Priority Data

Oct. 15, 1998 [TW] Taiwan ..... 87217078

[51] Int. Cl.[7] ..... F25D 3/08

[52] U.S. Cl. ..... 62/457.3; 62/438; 62/530

[58] Field of Search ..... 62/457.3, 530, 62/438

[56] References Cited

U.S. PATENT DOCUMENTS 4,782,670 11/1988 Long et al. ..... 62/530 X
4,981,022 1/1991 Snyder ..... 62/457.3
5,009,083 4/1991 Spinos et al. ..... 62/457.3 X
5,271,244 12/1993 Staggs ..... 62/457.3
5,964,102 10/1999 Tsai ..... 62/457.3

*Primary Examiner*—Henry Bennett
*Assistant Examiner*—Chen-Wen Jiang
*Attorney, Agent, or Firm*—Rosenberg, Klein & Lee

[57] ABSTRACT

A cooling mug has an inner mug part, and an outer mug part joined together with a room in between. The room holds cooling substance and a straw therein; the straw is connected to a lower end of the inner part, and communicates with inside of the inner part provided for holding drinks. The straw further projects from upper end of the mug so that a user can suck drinks from the straw. The mug is previously kept in a refigerator to become cold. Drinks will also flow into the straw after it is poured into mug; thus, drinks sucked up from the straw can become cooler because of the contact between the straw and cooling substance.

2 Claims, 4 Drawing Sheets

COOLING MUG

BACKGROUND OF THE INVENTION

The present invention relates to a cooling mug, which has cooling substance held within a space confined by an inner layer and an outer layer of the mug, and more particularly to one which has a straw disposed in the space between the inner layer and the outer layer in order to increase the cooling efficiency of the mug.

Referring to FIG. 5, a heretofore known cooling mug comprises an inner part 10, and an outer part 20. The inner part 10 has a holding portion 102, and a connecting portion 101, and is received within the outer part 20 with the connecting portion 101 connected to upper end of the outer part 20. Cooling substance, e.g. water and refrigerant, is held in the space confined by the inner part 10 and the outer part 20.

The mug is kept in a refrigerator for cooling substance therein to become cold. When drink is poured into such mug, i.e. the holding portion 102 of the inner part 10, the drink can become cool fast, and can be kept in such a cool condition longer by the cooling mug than an ordinary mug.

However, it is found that the heretofore known cooling mug has its disadvantages as follows, 1. If the drink poured into the mug has not been previously refrigerated, it will become cool too slowly to meet the user's need, i.e. the user cannot enjoy a cool drink immediately after the drink is poured into the mug.
2. The part of the drink, which is not close to the inner part 10 won't become cool easily.
3. The manufacturers usually put small ornamental metal chips in the space between the inner part and the outer part to make it look more attractive. However, the ornamental effect is less than optimal, and cannot make the mug attractive or competitive in the market.

SUMMARY OF THE INVENTION

It is a main object of the present invention to provide a cooling mug, which can cool drinks more quickly than the traditional cooling mug.

The cooling mug of the present invention has an inner part, and an outer part; the inner part is held within the outer part with a room in between like the traditional cooling mug. A straw is connected to a lower end of the inner part, and communicates with inside of the inner part. The straw further projects from upper end of the mug. The straw is wound around the inner part in the room, or it is shaped into various patterns such that cooling substance held in the room surrounds it.

When drinks are poured into the mug, it will also flow into the straw; thus, the drinks have more contact area with cooling substance and can be cooled more quickly. Even drinks having not been previously refrigerated can give the user a cooling feeling when sucked through the straw.

BRIEF DESCRIPTION OF THE DRAWINGS

The present invention will be better understood with reference to the accompanying drawings, wherein.

DETAILED DESCRIPTION OF THE PREFERRED EMBODIMENTS

Figure 1:
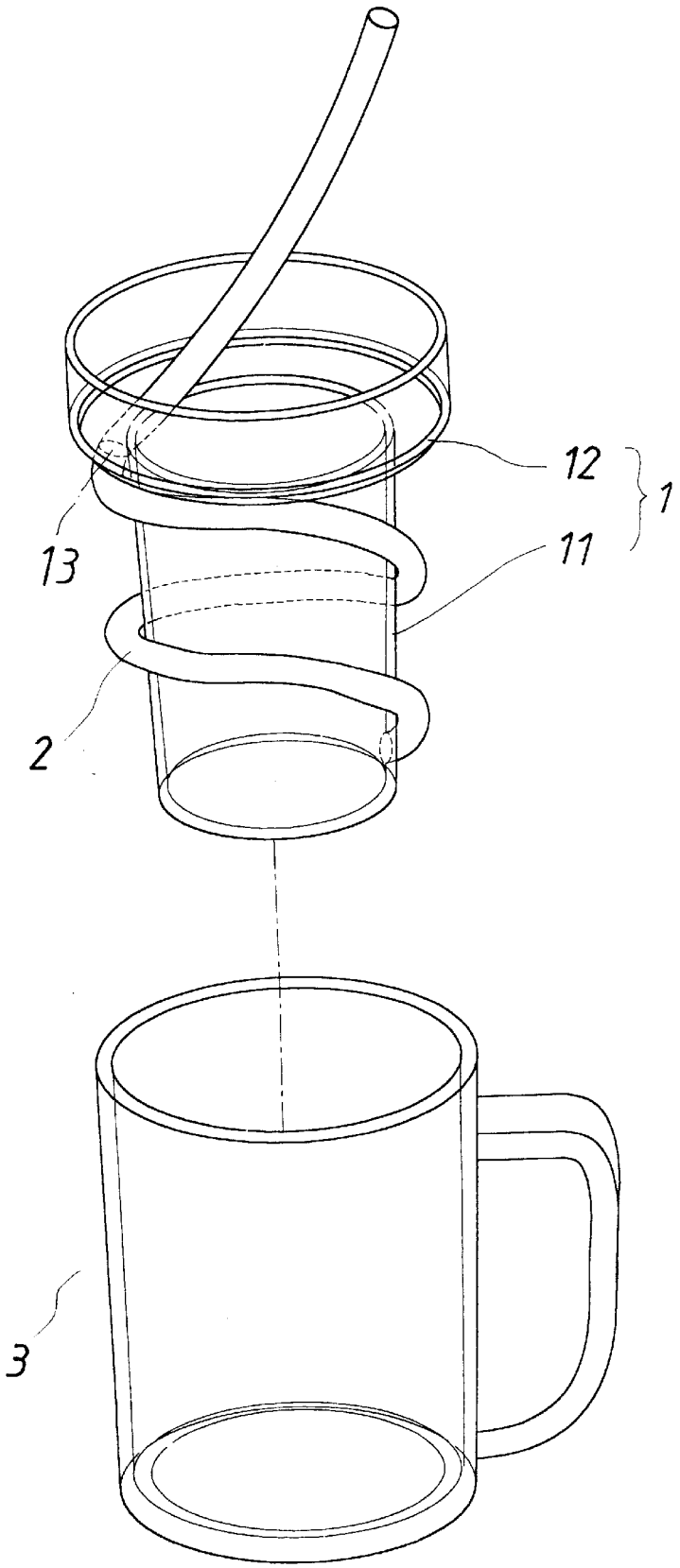
FIG. 1 is an exploded perspective view of a cooling mug of the present invention.
Figure 3:
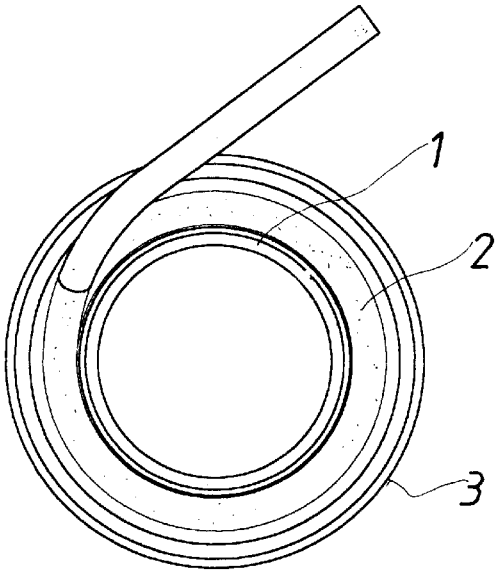
FIG. 3 is a top view of the cooling mug of the present invention.
Figure 2:
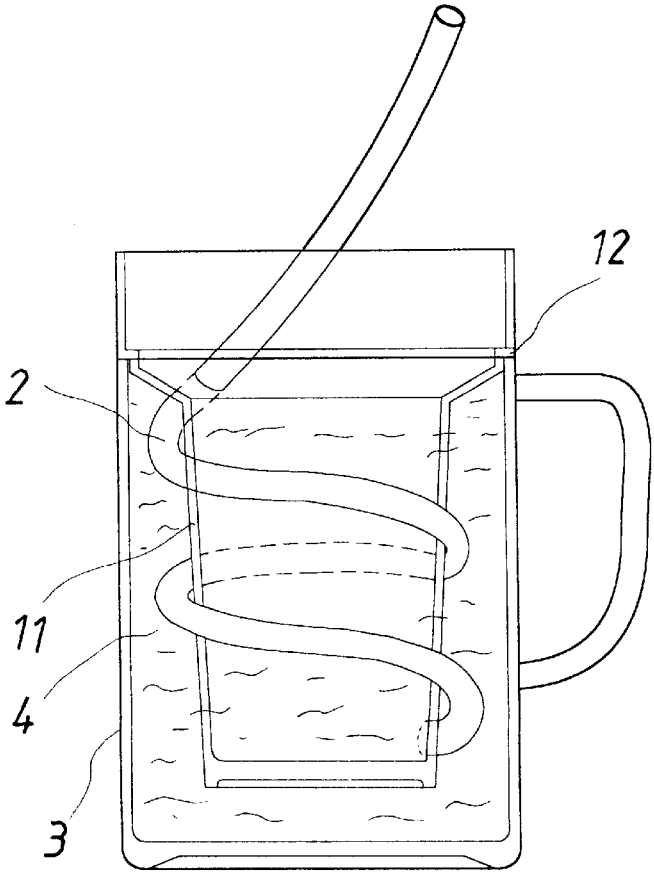
FIG. 2 is a view of a cooling mug of the present invention.

A cooling mug of the present invention, referring to FIGS. 1 and 2, comprises an inner part 1 of the mug body, an outer part 3 of the mug body, and a straw 2 as the main parts.

The inner part 1 is held within the outer part 3 with space in between. Cooling substance or refigerant is disposed in the space.

The straw 2 is provided for a user to suck up drinks therefrom. A lower end of the straw 2 is connected to a lower end portion of the inner part 1, and communicates with the inside of the inner part 1 such that drinks held in the inner part can be sucked up through the straw 2 by the user. The inner part 1 of the mug includes a holding part 11 and a connecting part 12 connected to upper end of the holding part 11. The holding part 11 is provided for holding drinks therein. The connecting part 12 is contoured to the shape of the outer part 3 such that the connecting part 12 can be firmly connected to the outer part 3 of the mug. Furthermore, the connecting part 12 has a through hole 13, as shown in FIG. 1, for upper end portion of the straw 2 to pass therethrough such that the user can use the straw 2.

The straw 2 can be wound around the inner part 1 between the lower end thereof and the through hole 13 such that the part of the straw 2 that is received within the mug is lengthened.

The straw 2 received within the space between the inner part 1 and the outer part 3 can be shaped to have various patterns for decoration, e.g. star patterns, heart patterns, and flowery patterns.

Moreover, the joint between the outer part 3 and the connecting part 12 of the inner part 1 is sealed up by the means well known by those skilled in the art such that cooling substance held between the inner part 1 and the outer part 3 is secured from leaking out of the mug. For instance, ultrasonic melting can be used to connect the above said. However, the way of connecting is not the subject of the present invention, and so is not further discussed here. The joint between the through hole 13 and the straw 2 is also sealed up to prevent cooling substance from leaking out.

In using the cooling mug of the present invention, first the cooling mug is kept in a refrigerator for cooling substance of the mug to become cold or to freeze. Then, the mug is used to hold a drink, e.g. beer and juice, by pouring it into the inner part 1 thereof; drinks will also flow into the straw 2. Thus, cooling substance can cool the drink inside the inner part 1 as well as that inside the straw 2.

It can be easily seen that the cooling mug of the present invention provides drinks with more contact area with cooling substance than the prior art cooling mug as described in the Background, because of provision of the straw 2. Drinks can be cooled more quickly. When the user sucks up drinks from the straw 2 instead of from the connecting part 12, drinks can be cooler because drinks have been flowing through the straw 2.

From the above description, it can be understood that the cooling mug of the present invention has following advantages.

1. Drinks can be cooled more quickly with more contact area with cooling substance because of provision of the straw 2.

2. Because of the straw 2, drinks sucked up from the straw 2 can give the user a cooling feeling even the drink is just poured into the mug.

Figure 4:
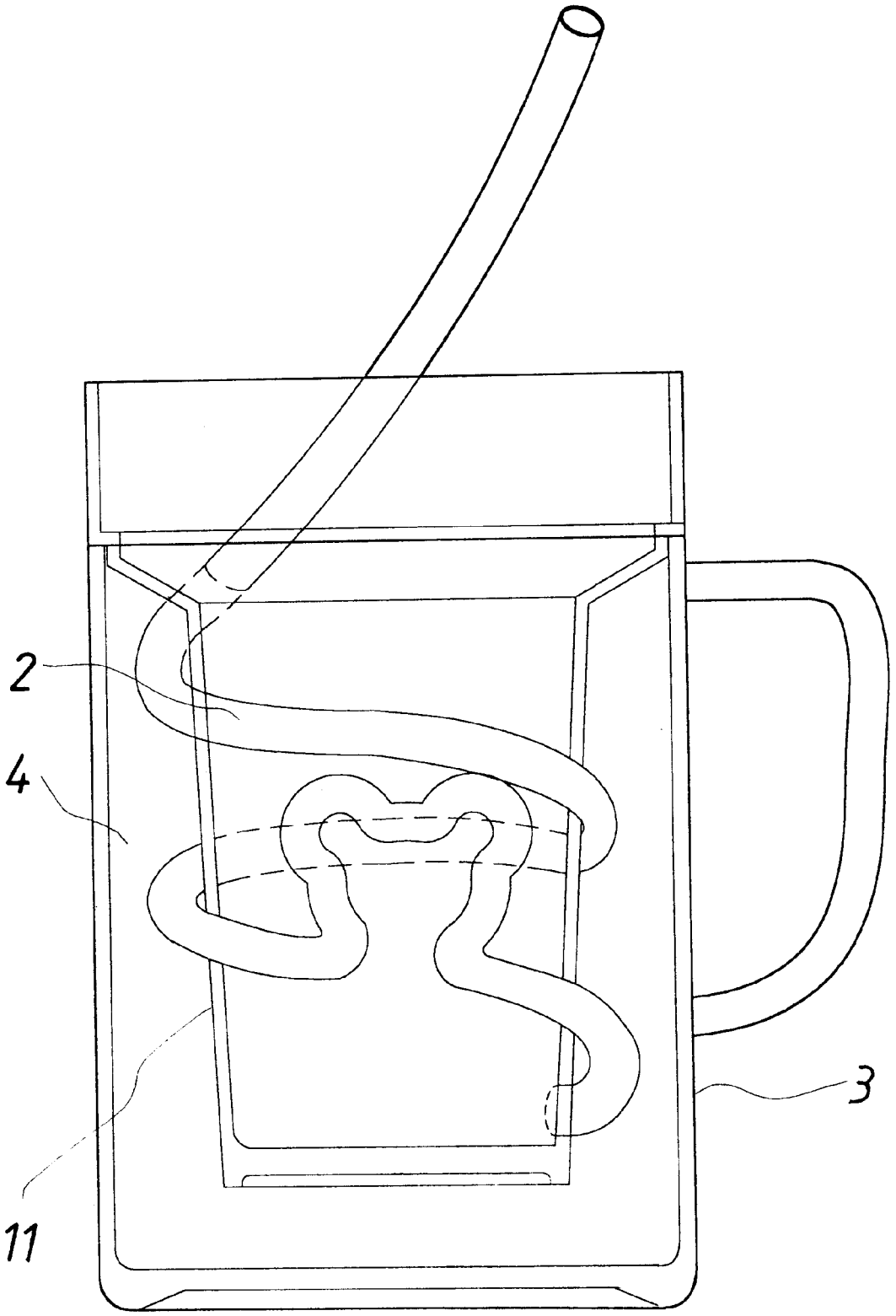
FIG. 4 is a view of another embodiment of the present invention.
Figure 5:
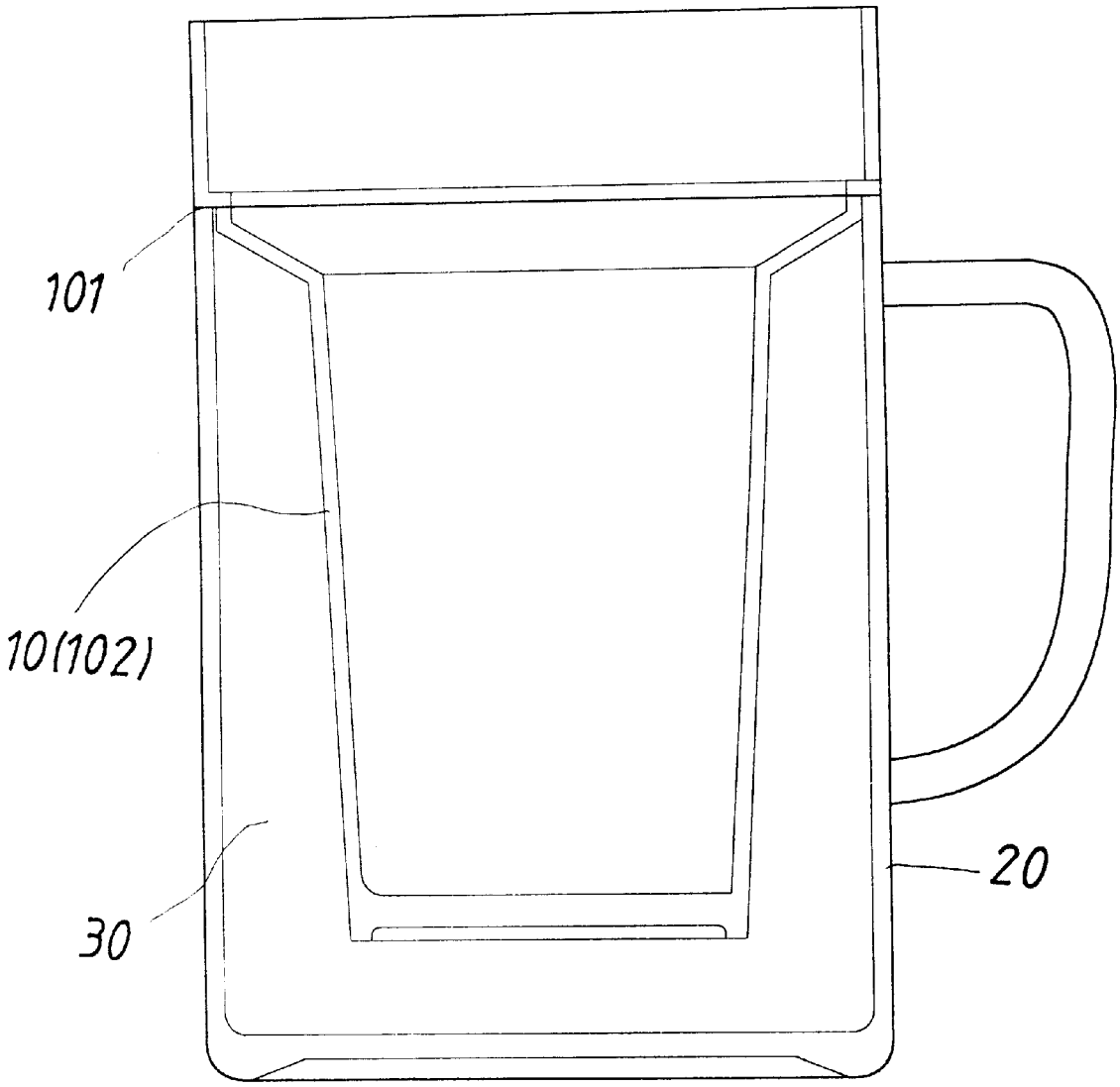
F I G. 5 (PRIOR ART)
FIG. 5 is a sectional view of a prior art cooling mug as described in the Background.

3. The straws 2 of various patterns, e.g. the bear head as shown in FIG. 4, can make the mug more attractive and lovely, and consequently more competitive in the market.

What is claimed is:

1. A cooling mug comprising an inner part having a holding part at a lower portion thereof, and a connecting part connected to an upper end of said holding part;

a straw connected to a lower end of said inner part, said straw being post through a through hole of said connecting part, and communicating with inside of said inner part;

an outer part holding said inner part therein, and firmly connected to said connecting part of said inner part from an upper end portion thereof, said inner part and said outer part forming a space in between; and, cooling substance disposed in said space between said inner part and said outer part.

2. A cooling mug as claimed in claim 1, wherein siad straw is wound around said inner part of said mug.

* * * * *